United States Patent [19]

Clay

[11] Patent Number: 4,558,726

[45] Date of Patent: Dec. 17, 1985

[54] HAMMER WITH REPLACEABLE HEAD

[76] Inventor: Howard W. Clay, c/o Endall Company, 5083 27th Ave., Rockford, Ill. 61109

[21] Appl. No.: 615,154

[22] Filed: May 30, 1984

Related U.S. Application Data

[63] Continuation-in-part of Ser. No. 257,729, Apr. 27, 1981, abandoned.

[51] Int. Cl.[4] ..... B25D 1/00

[52] U.S. Cl. ..... 81/25; 81/20

[58] Field of Search ..... 145/29 R, 29 A, 29 B, 145/29 C, 29 D, 36; 81/463; D8/75

[56] References Cited

U.S. PATENT DOCUMENTS

| | | | |
|---|---|---|---|
| 1,633,007 | 6/1927 | Ehinger | 145/29 R |
| 2,489,841 | 11/1949 | Wyllie | 145/29 R |
| 2,570,691 | 10/1951 | Kindland | 145/29 R |
| 2,763,172 | 9/1956 | Richards | 145/29 R |
| 2,894,550 | 7/1959 | Clay | 145/36 |
| 3,042,092 | 7/1962 | Ekstrom | 145/29 A |
| 3,129,737 | 4/1964 | Citroen | 145/29 R |
| 3,211,198 | 10/1965 | Glasgow | 145/29 A |
| 3,394,745 | 7/1968 | Kuchins | 145/29 R |
| 3,901,297 | 8/1975 | Young | 145/29 A |

FOREIGN PATENT DOCUMENTS

| | | | |
|---|---|---|---|
| 0830030 | 1/1952 | Fed. Rep. of Germany | 145/29 A |
| 0937788 | 3/1948 | France | 145/29 R |

*Primary Examiner*—Frederick R. Schmidt
*Assistant Examiner*—Robert A. Rose
*Attorney, Agent, or Firm*—Leydig, Voit & Mayer, Ltd.

[57] ABSTRACT

A strap is secured to the head of the hammer and interlocks with a strap on the handle of the hammer when the head is assembled with the handle. The two interlocking straps prevent the head from turning on the handle when the hammer is used.

9 Claims, 8 Drawing Figures

HAMMER WITH REPLACEABLE HEAD

This is a continuation-in-part of application Ser. No. 257,729, filed Apr. 27, 1981, now abandoned.

BACKGROUND OF THE INVENTION

This invention relates to a hammer having an elongated handle and having a relatively soft head made of a castable or moldable material such as lead, babbit, brass, plastic or rubber. Because of the soft nature of the head, it tends to wear relatively quickly. It is, therefore, desirable to attach the head releasably to the handle so that a worn head can be replaced with a new head.

Difficulty has been encountered, however, in keeping the detachable heads of prior hammers secured tightly to the handles during service use. When prior hammers are used repeatedly to strike heavy blows, the head tends to loosen and turn on the handle. The problem of keeping the head connected tightly to the handle is compounded by the fact that the material of the head is relatively soft and tends to flow away from and release the elements used to fasten the head to the handle.

SUMMARY OF THE INVENTION

The general aim of the present invention is to provide a new and relatively inexpensive hammer having a soft head which may be quickly attached to and released from the handle and which, when compared with prior heads, remains more securely attached to the handle during service use.

A more detailed object of the invention is to achieve the foregoing by providing a hammer having a handle and a head with unique means which interlock with one another as an incident to assembling the head onto the handle and which prevent the head from turning once the head has been finally tightened on the handle.

Still another object is to provide a hammer in which the head and the handle include novel straps which coact to form a tight captivating sleeve around the head when the head is placed on the handle.

The invention also resides in the unique manner of forming the strap of the head as an incident to forming the handle and in the novel manner in which that strap is captivated on the head as an incident to forming the head.

These and other objects and advantages of the invention will become more apparent from the following detailed description when taken in conjunction with the accompanying drawings.

DETAILED DESCRIPTION OF THE PREFERRED EMBODIMENT

Figure 1:
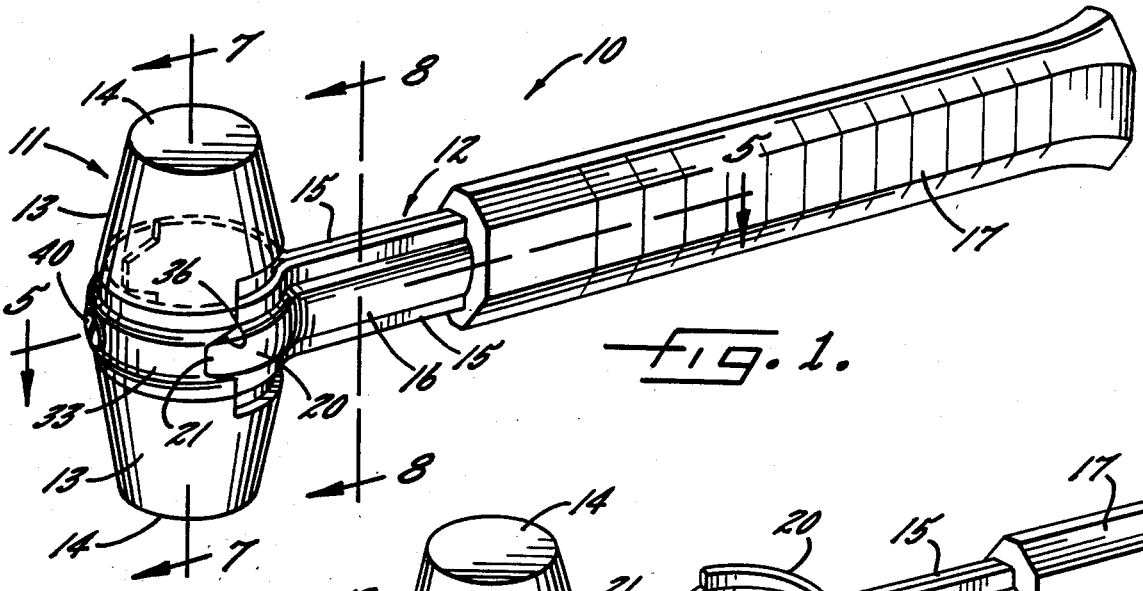
FIG. 1 is a perspective view of a new and improved hammer incorporating the unique features of the present invention.

As shown in the drawings for purposes of illustration, the invention is embodied in a mallet-type hammer 10 having a head 11 which is attached to an elongated handle 12. The head may be cast or molded from a relatively soft material such as lead, babbit, brass, plastic or rubber. In this particular instance, the head is cast from lead and includes two oppositely tapered frustums 13. The small end of each frustum forms a striking face 14.

The head 11 is attached releasably to the handle 12 in order to enable the head to be removed and replaced with a new head. In accordance with the present invention, the head and the handle are uniquely constructed to enable the head to be quickly and easily attached to and detached from the handle but, at the same time, to hold the head tightly on the handle and to prevent the head from loosening and turning when the hammer 10 is used to strike heavy and repeated blows.

Figure 5:
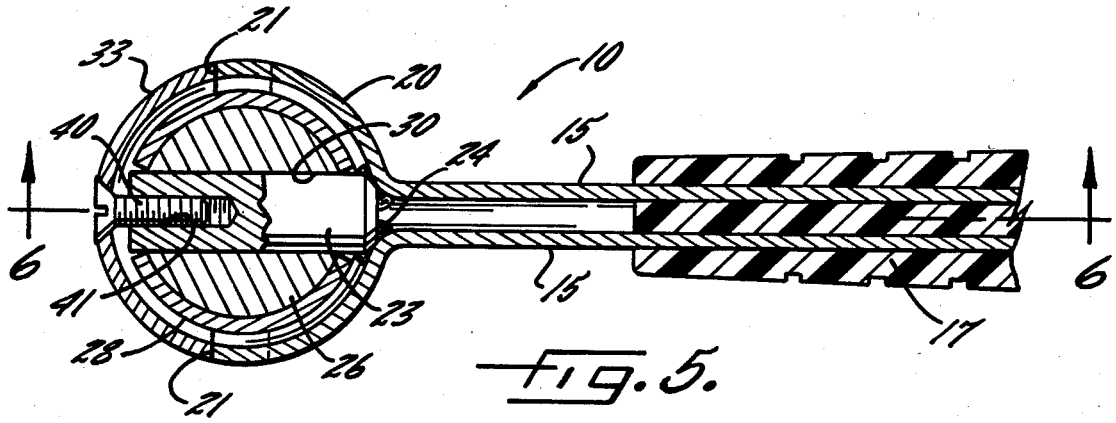
FIG. 5 is an enlarged fragmentary cross-section taken substantially along the line 5—5 of FIG. 1.
Figure 6:
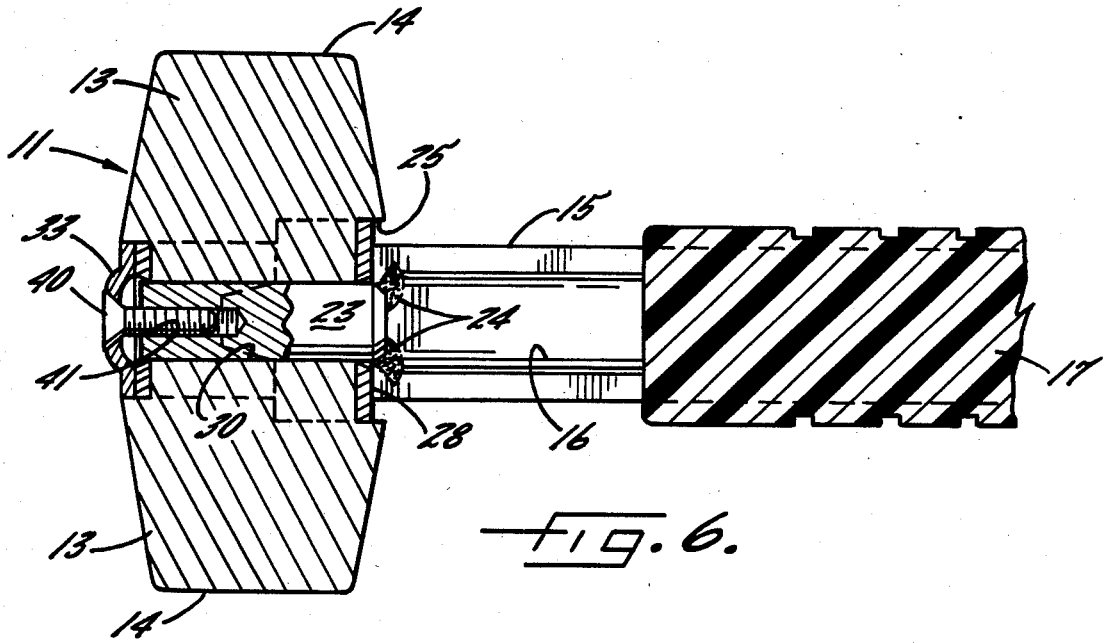
FIG. 6 is a fragmentary cross-section taken substantially along the line 6—6 of FIG. 5.
Figure 8:
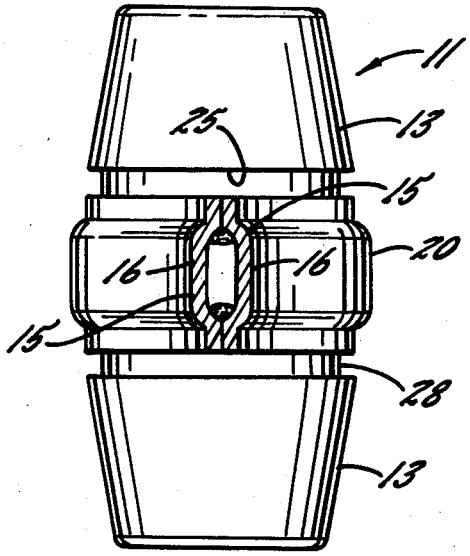

More specifically, the handle includes a pair of elongated strips 15 (FIG. 5) made of heavy gage sheet metal and disposed in face-to-face relation. While the strips could be flat, they herein are formed with stiffening ribs 16 (FIGS. 6 and 8). Near their outer ends, the strips are welded to one another along their side edges and, if desired, the strips may be welded together at spaced points along their length or along their entire length. A plastic or rubber hand grip 17 is molded over a substantial length of the strips.

Figure 2:
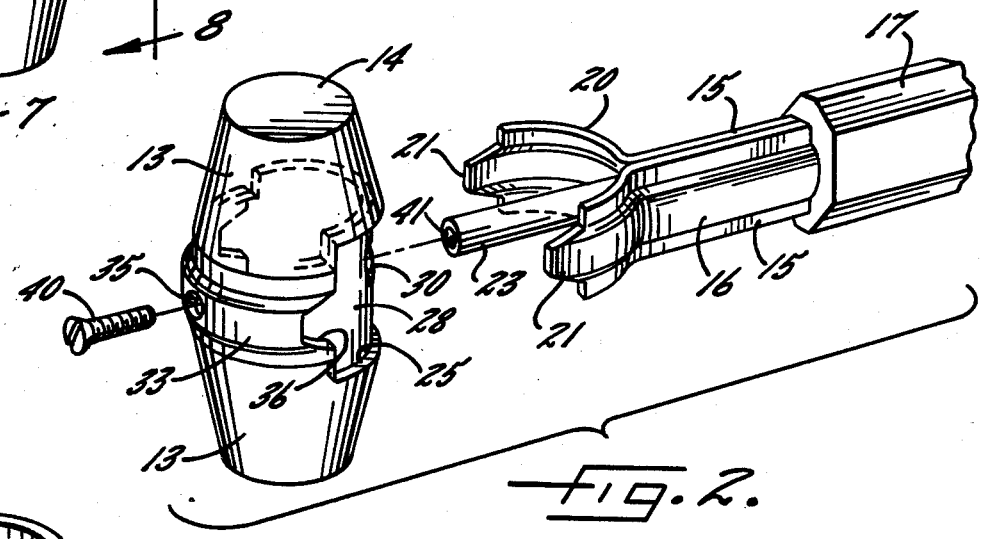
FIG. 2 is an exploded perspective view of the hammer.

Pursuant to the invention, the handle 12 includes an arcuate cradle or strap 20 located adjacent the outer ends of the strips 15. Herein, the strap is substantially semi-circular and is advantageously formed by bending the outer end portion of each strip so that the two end portions coact to form the generally C-shaped strap. In carrying out the invention, key means or tabs 21 (FIG. 2) are formed integrally with and project from the ends of the strap.

The handle 12 is completed by a projection or stud 23 (FIG. 2) which is centered within the strap 20. The inner end of the stud is welded at 24 (FIG. 5) to the mid-portion of the strap while the outer end of the stud projects outwardly beyond the tabs 21.

A groove 25 (FIG. 7) is formed around the head 11 midway between the frustums 13 and thus the head includes a cylindrical midportion 26 whose diameter is smaller than the larger diameter of each frustum. When the head is made from lead, a cylindrical sleeve 28 made of steel or other hard material encirlces the cylindrical midportion 26 to captivate the soft, flowable material thereof and to prevent such material from expanding when the hammer 10 is used. The bottom of the groove 25 thus is formed by the outer diameter of the sleeve 28 but such diameter is smaller than the larger diameter of each frustum 13. Hence, the groove 25 exists between the frustums in spite of the presence of the sleeve 28 (see FIG. 7).

The sleeve 28 is placed in the molds when the head 11 is cast and thus is filled with lead as an incident to the casting operation. The sleeve may either be formed by a seamless tube or by an initially flat sheet or metal which is wrapped into a tube-like configuration by suitable dies.

A hole 30 (FIGS. 5 to 7) is formed diametrically through the sleeve 28 and the cylindrical portion 26 of the head 11. When the head is assembled with the handle 12, the stud 23 extends into the hole 30 while the strap 20 seats within the groove 25 and extends approximately half-way around the groove.

In carrying out the invention, a second C-shaped strap 33 is seated within and extends around the remainder of the groove 25 and is secured tightly to the head 11. The strap 33 also is made of heavy gage sheet metal and herein is secured to the head by welding the strap to the outer side of the sleeve 28 as indicated at 34 in FIG. 3. The strap 33 preferably is welded to the sleeve 28 before the sleeve is placed in the molds and before the head 11 is cast.

A countersunk hole 35 (FIG. 2) is formed in the strap 33 and is alined with the hole 30. Importantly, key means or notches 36 are formed in the end portions of the strap 33 and are complementary in size and shape with the tabs 21.

With the foregoing arrangement, the head 11 is assembled with the handle 12 by telescoping the head onto the stud 23 and causing the head to seat within the strap 20. As an incident to such telescoping, the notches 36 in the strap 33 snugly receive and interlock with the tabs 21 of the strap 20. Assembly of the hammer 10 is completed by securing the head 11 to the handle 12 with a fastener 40. The fastener may, for example, be a screw which is inserted through the hole 35 in the strap 33 and which is threaded tightly into a tapped hole 41 (FIGS. 2 and 5) in the outer end of the stud 23.

By virtue of the tabs 21 interlocking with the notches 36, the two straps 20 and 33, in effect, form a continuous sleeve around the head 11 once the head is assembled onto the handle 12. Since one part of the sleeve (i.e., the strap 20) is rigid with the handle and since another part of the sleeve (i.e., the strap 33) is rigid with the head, the head is prevented from turning relative to the handle about all axes. Because the straps are made of relatively hard metal, the tight fit between the tabs 21 and the notches 36 is maintained during use of the hammer and thus there is little danger of the head working loose on the handle even though heavy blows are struck with the hammer. When the lead frustums 13 wear down, the head may be easily removed from the handle simply by loosening the screw 40 and pulling the head away from the handle.

Figure 3:
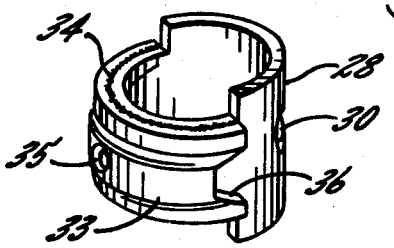
FIG. 3 is a perspective view of the strap of the head and of a sleeve for securing the strap to the head.
Figure 7:
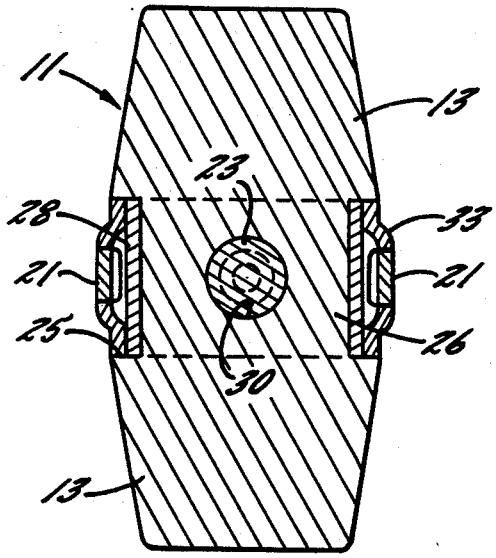
FIGS. 7 and 8 are enlarged fragmentary cross-sections taken substantially along the lines 7—7 and 8—8, respectively, of FIG. 1.

As shown in FIGS. 6 and 7, that portion of the groove 25 that receives the strap 33 is equal in width to the strap and thus the strap is received snugly within the groove 25. That portion of the groove 25 that receives the strap 20, however, is considerably wider than the strap as shown in FIGS. 1, 6 and 8. As a result, there is lateral clearance between the strap 20 and the frustums 13 so that, when the frustums become deformed during use, the deformed lead will not flow over the strap 20 and prevent the head from being separated from the strap when it is desired to remove the head from the handle 12. To enable the two portions of the groove 25 to be formed with different widths when the head 11 is cast, the sleeve 28 is formed with two portions of different widths as shown in FIG. 3.

Figure 4:
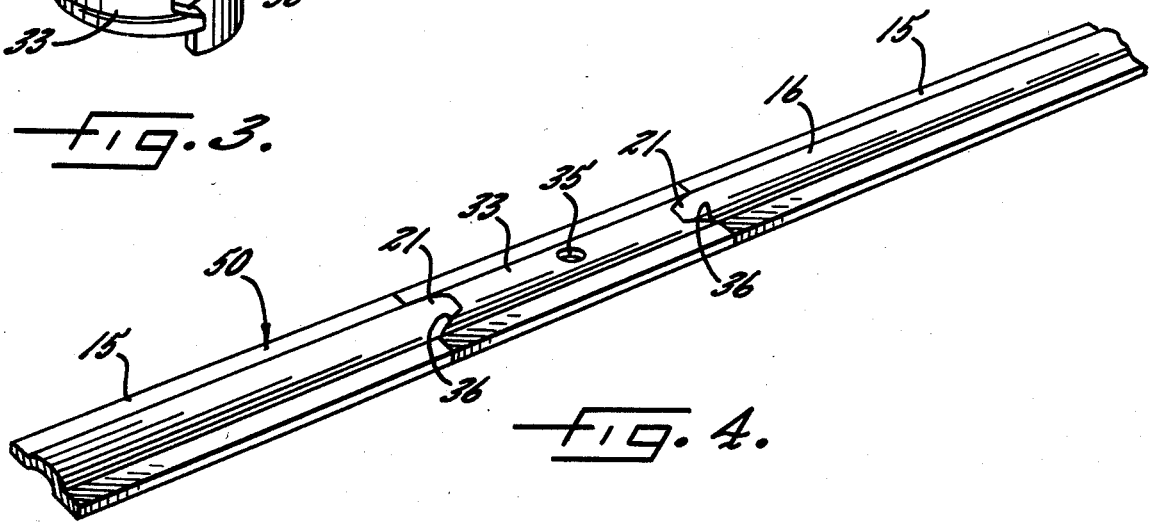
FIG. 4 is a perspective view of a piece of metal from which the handle and the strap of the head are formed.

To reduce manufacturing costs, the strips 15 and the strap 20 of the handle 12 and the strap 33 of the head 11 preferably are formed from a single and initially flat blank 50 (FIG. 4) of sheet metal. First, the midportion of the blank is stamped to blank out the strap 33 with the tabs 21, the notches 36 and the hole 35 being formed as an incident to the blanking operation. The blanked-out midportion then is formed into substantially a C-shape to make the strap 33 and, in addition, the tabbed end sections of the end portions of the blank are suitably formed to make the curved portions of the strap 20 on the ends of the strips 15. All of the foregoing operations may be performed rapidly by a progressive die.

If the head 11 is made of relatively hard material such as brass, the sleeve 28 and the strap 33 may be eliminated. In such an instance, the head may be formed with a semi-circular groove for receiving the strap 20 and, at the ends of the groove, notches similar to the notches 36 may be formed for receiving the tabs 21.

I claim:

1. A hammer having a handle and a head, a hole extending through said head, an elongated threaded projection joined rigidly to and extending from said handle and telescoped into the hole in said head, a strap joined rigidly to one end portion of said handle and defining a cradle for said head, said strap straddling said projection, key means on the ends of said strap, complementary key means joined rigidly to said head and interfitting with the key means on said strap to prevent said head from turning relative to said handle, and a threaded fastener releasably securing said head against separation from said handle, said threaded fastener being threadably connected to said projection and clamping against said head, said strap and said projection being joined rigidly to said handle independently of said threaded fastener, and said complementary key means being joined rigidly to said head independently of said threaded fastener.

2. A hammer as defined in claim 1 in which said handle is formed by a pair of elongated sheet metal strips secured together in face-to-face relation, said strap being formed by two portions with one of said portions being integral with one of said strips and with the other of said portions being integral with the other of said strips.

3. A hammer as defined in claim 1 further including a second strap welded rigidly to said head and joined to said head independently of said threaded fastener, said complementary key means being on the ends of said second strap, a groove formed around said head between the ends thereof and having first and second portions, said first and second straps being located within the first and second portions, respectively, of said groove, the first portion of said groove being significantly wider than said first strap to enable said first strap to be freely inserted into and removed from said groove, and the second portion of said groove being very nearly the same width as said second strap and snugly receiving said second strap.

4. A hammer having a metal handle and a metal head, a first metal strap welded rigidly to said head by a metal-to-metal weld and extending part way around said head between the ends thereof, a hole formed through said strap, a hole extending through said head and alined with the hole in said strap, an elongated projection made of metal and joined rigidly to said handle by a metal-to-metal weld, said projection extending from said handle and telescoped into the hole in said head, said projection being internally threaded, a screw extending through the hole in said strap and threaded into said projection thereby to releasably secure said head to said handle, a second strap joined rigidly with said handle and extending substantially around the remainder of said head, said second strap straddling said projection, said straps being joined to said head and said handle solely by said welds and independently of said screw, and means on the end portions of said second strap and adapted to interlock with means on the end portions of said first strap when said head is telescoped onto said projection, said means being operable when interlocked with one another to prevent said head from turning relative to said handle.

5. A hammer as defined in claim 4 in which a groove is formed around said head between the ends thereof and includes first and second portions, said first and second straps being located within the first and second portions, respectively, of said groove, the first portion of said groove being approximately the same width as said first strap, and the second portion of said groove being significantly wider than said second strap.

6. A hammer having a handle and a head, said head being made of a material capable of being molded or cast, a groove formed in said head between the ends thereof and extending around the circumference of said head, a sleeve disposed within said groove and encircling said head, said sleeve being fixed against movement relative to said head, a first strap disposed within and extending part way around said groove and joined rigidly to the outer side of said sleeve, a hole formed in said strap, holes extending diametrically through said head and said sleeve and alined with the hole in said strap, an elongated projection welded to and extending from said handle and telescoped into the holes in said head and said sleeve, said projection being internally threaded, a screw extending through the hole in said strap and threaded into said projection thereby to releasably secure said head to said handle, a second strap joined rigidly with said handle, said straps being joined rigidly with said sleeve and said handle independently of said screw, said second strap being seated in said groove, extending substantially around the remainder of the groove, and having end portions straddling said projection, and means on the end portions of said second strap and adapted to interlock with means on the end portions of said first strap when said head is telescoped onto said projection, said means being operable when interlocked with one another to prevent said head from turning relative to said handle.

7. A hammer as defined in claim 6 in which said groove is substantially circular, each of said straps being substantially semicircular.

8. A hammer as defined in claim 6 in which the means on the end portions of one of said straps comprise tabs projecting from such end portions, the means on the end portions of the other strap comprising notches formed in the latter end portions and sized to snugly receive said tabs.

9. A hammer as defined in claim 7 in which said sleeve is made of a material which is harder than the material of said head, said sleeve being filled with the material of said head.

* * * * *